United States Patent [19]

Matayoshi et al.

[11] Patent Number: 4,881,497

[45] Date of Patent: Nov. 21, 1989

[54] VALVE OPERATING SYSTEM FOR INTERNAL COMBUSTION ENGINE

[75] Inventors: Yutaka Matayoshi, Yokosuka; Shigeru Kamegaya, Tokyo, both of Japan

[73] Assignee: Nissan Motor Co., Ltd., Yokohama, Japan

[21] Appl. No.: 197,886

[22] Filed: May 24, 1988

[30] Foreign Application Priority Data

May 25, 1987 [JP] Japan ..... 62-125758

[51] Int. Cl.[4] ..... F01M 9/10

[52] U.S. Cl. ..... 123/90.34; 123/90.36

[58] Field of Search ..... 123/90.34, 90.36, 90.4, 123/90.46, 90.55

[56] References Cited

U.S. PATENT DOCUMENTS

| | | | |
|---|---|---|---|
| 3,153,404 | 10/1964 | Slooten | 123/90.34 |
| 3,314,404 | 4/1967 | Thompson | 123/90.34 |
| 3,502,058 | 3/1970 | Thompson | 123/90.34 |
| 4,481,913 | 11/1984 | Wirth | 123/90.55 |
| 4,481,919 | 11/1984 | Honda et al. | 123/90.46 |
| 4,589,383 | 5/1986 | Showalter | 123/90.36 |
| 4,690,110 | 9/1987 | Nishimura et al. | 123/90.4 |

FOREIGN PATENT DOCUMENTS

| | | | |
|---|---|---|---|
| 0079018 | 5/1984 | Japan | 123/90.46 |

*Primary Examiner*—Charles J. Myhre
*Assistant Examiner*—Weilun Lo
*Attorney, Agent, or Firm*—Foley & Lardner, Schwartz, Jeffery, Schwaab, Mack, Blumenthal & Evans

[57] ABSTRACT

A valve operating system for an overhead camshaft type automotive internal combustion engine. The valve operating system is comprised of a swing arm swingable upon rotation of a camshaft located over the swing arm. The swinging motion of the swing arm causes the reciprocal motion of intake or exhaust valve which is connected to one end section of the swing arm. The other end section of the swing arm is pivotally supported by the plunger of a hydraulic lifter in such a manner that the swing arm end section is in fitting contact with the tip end section of the hydraulic lifter plunger. A clearance is formed between the swing arm end section and the plunger tip end section and filled with lubricating oil which is supplied through an oil supply passage formed in the plunger of the hydraulic lifter, thereby accomplishing sufficient and efficient lubrication at the contacting and sliding surface between the swing arm and the hydraulic lifter plunger.

13 Claims, 4 Drawing Sheets

VALVE OPERATING SYSTEM FOR INTERNAL COMBUSTION ENGINE

BACKGROUND OF THE INVENTION

1. Field of the Invention

This invention relates generally to improvements in a valve operating system for an internal combustion engine which system is arranged such that rotation of a camshaft is converted through a swing arm to reciprocal movement of intake or exhaust valve, and more particularly to a device for lubricating parts of the valve operating system in order to prevent abnormal wear and damage to the parts.

2. Description of the Prior Art

Internal combustion enignes are provided with a valve operating system for operating intake or exhaust valve to open and close. A variety of the valve operating systems are proposed and put into practical use. For example, an overhead camshaft engine is provided with such a valve operating system that a swing arm is swingably disposed to cause intake or exhaust valve to open or close. The swing arm is driven to swing by a camshaft located over the swing arm and pivotally supported at its one end by a support member such as a hydraulic lifter. The other end of the swing arm is connected to the valve stem of the intake or exhaust valve and adapted to make reciprocal movement of the valve stem of the intake or exhaust valve under swinging movement of the swing arm. In such an engine operating system, there are many contacting and sliding parts which require lubrication. Particularly, the pivotal connection between the swing arm end and the support member requires sufficient lubrication because the pivotal connection is under a severe sliding condition. In this regard, it has been eagerly desired to provide a lubricating device which can effectively lubricate the contacting and sliding sections of the valve operating system particularly a contacting and sliding section between the swing arm and the support member.

SUMMARY OF THE INVENTION

It is an object of the present invention to provide an improved valve operating system for an internal combustion engine, for achieving sufficient and efficient lubrication for the contacting and sliding sections of parts of the valve operating system.

Another object of the present invention is to provide an improved valve operating system for an internal combustion enigne, in which a clearance is formed between one end section of a swing arm and a support member in fitting contact with the swing arm end section so as to achieve sufficient lubrication therebetween.

The valve operating system for an internal combustion engine, according to the present invention is comprised of a swing arm having first and second end sections. The first end section is connected to an engine valve such as an intake valve or exhaust valve. The swing arm is swingable around the second end section upon rotation of a camshaft. The second end section fittingly contacts with an end section of a support member secured to the body of the engine. A clearance is formed between the swing arm second end section and the support member end section. The clearance is filled with lubricating oil supplied through an oil supply passage formed in the support member.

Accordingly, lubricating oil is fed to the contacting surface between the swing arm second end section and the support member end section through the oil supply passage formed in the support member. Additionally, the clearance to be filled with lubricating oil is formed between the swing arm second end section and the support member end section. Consequently, a considerable amount of lubricating oil is kept between the swing arm second end section and the support member end section, thereby achieving sufficient and effective lubrication at the contacting surface between the swing arm and the support member. This prevents abnormal wear and damage of the contacting section between the swing arm and the support member.

BRIEF DESCRIPTION OF THE DRAWINGS

In the drawings, the same reference numerals designate the same elements and parts throughout all the figures, in which.

DETAILED DESCRIPTION OF THE INVENTION

Figure 1:
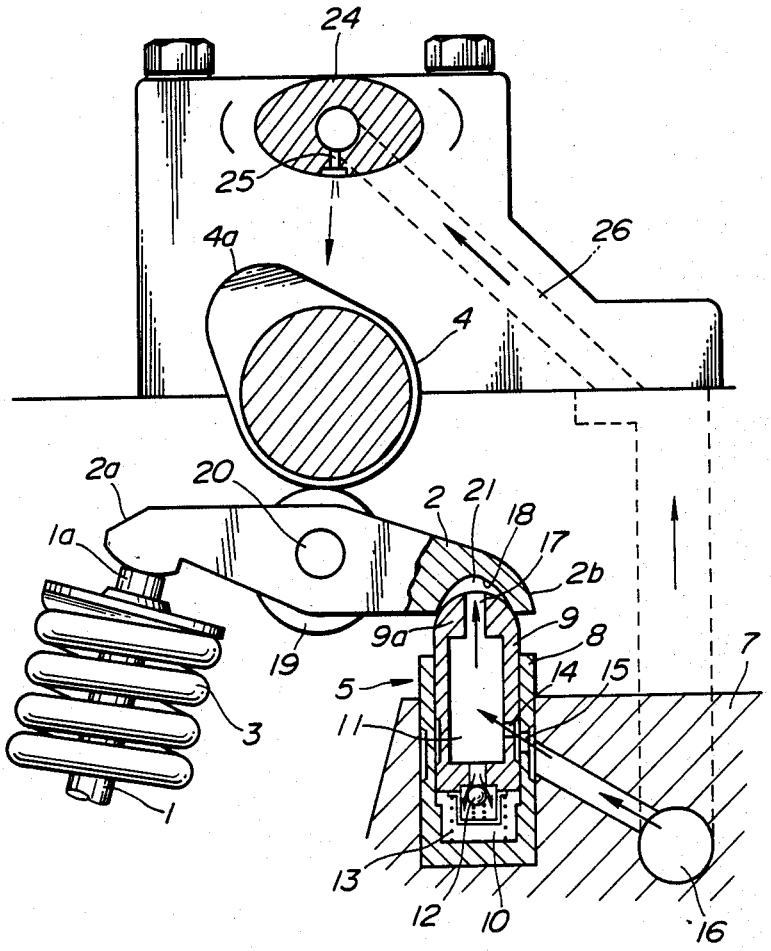
FIG. 1 is a fragmentary side view, partly in section, of a first embodiment of a valve operating system in accordance with the present invention.
Figure 2:
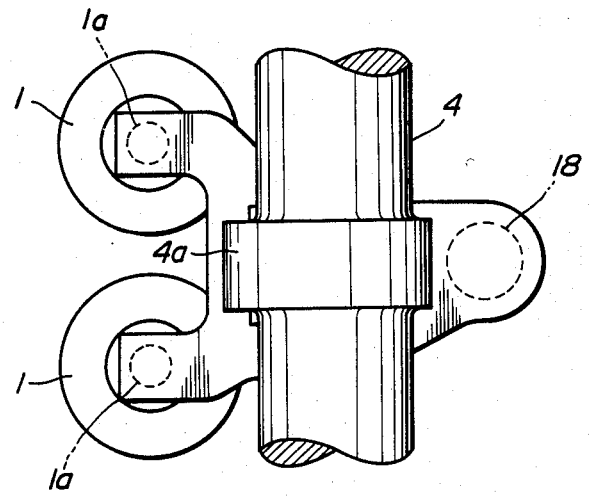
FIG. 2 is a plan view of an essential part of the valve operating system of FIG. 1.

Referring now to FIGS. 1 and 2, there is shown an essential part of a first embodiment of a valve operating system according to the present invention, for an overhead camshaft internal combustion engine. In this embodiment, the internal combustion engine is of an automotive vehicle. The valve operating system comprises a swing arm 2 whose one end section **2*a* is bifurcated into two portions which are respectively brought into contact with the stem ends of valve stems 1*a* each forming part of an engine valve (an intake or an exhaust valve) 1. The valve stem 1a is biased in a direction to close the engine valve 1 under the action of a valve spring 3. The other end section 2*b* of the swing arm 2 is fittingly supported by a plunger 9 of a hydraulic lifter 5. A cam follower roller 19 is rotatably supported through a roller shaft 20 to the swing arm 2. The cam follower roller 19 is in slidable contact with a cam 4*a* of a camshaft 4 driven by the engine. Accordingly, upon rotation of the camshaft 4, the swing arm 2 swings around its end section 2*b* thereby to cause the valve stem 1*a*** to move upward and downward.

The end section **2*b* of the swing arm 2 is formed at its lower side with a circular depression 18 in which a generally hemispherical tip end or pivot section 9*a* of the plunger 9 is fitted in such a manner as to provide sealing contact between the swing arm end section 2*b* and the plunger tip end 9*a*. Thus, the swing arm end section 2*b* serves as a swing fulcrum while the plunger tip end section 9*a* serves as a support fulcrum. It is to be noted that a sealed clearance 21 is formed between the inside surface of the swing arm circular depression 18 and the outer surface of the plunger tip end 9*a*, in which sealing is maintained at the circular contact between the swing arm depression 18 and plunger tip end 9*a*. The clearance 21 is supplied with lubricating oil through a commication hole 17 from an oil chamber 11 formed in the plunger 9, thereby accomplishing lubrication between the surface of the swing arm depression 18 and the surface of the plunger tip end section 9***a*. Clearance 21 has a central axis which is perpendicular to its uppermost surface. As seen in FIG. 1, clearance 21 decreases radially from this central axis to depression 18 towards the uppermost surface.

The plunger 9 is slidably fitted in a lifter body 8 whose major part is embedded in the body or cylinder hed 7 of the engine. The oil chamber 11 is supplied with lubricating oil from a lubricating oil passage 16 formed in the cylinder head 7 through a port 14 formed through the cylindrical wall of the plunger 9 and a port 15 formed through the cylindrical wall of the lifter body 8. Additionally, the oil chamber 11 is communicable with an oil pressure chamber 10 through a hole (no numeral) formed through the bottom wall of the plunger 9. The oil pressure chamber 11 is defined between the bottom wall of the plunger 9 and the lifter body 8. A ball-type check valve 12 is located in the oil pressure chamber 10 and biased to close the hole of the plunger bottom wall under the bias of a spring (no numeral), so that lubricating oil can flow from the oil chamber 11 to the oil pressure chamber 10. A spring 13 is disposed between the bottom wall of the plunger 9 and the bottom wall of the lifter body 8 to bias the plunger 9 upward.

The lubricating oil passage 16 is further communicated through an oil supply passage 26 with an oil ejection opening 25 formed in a cam bracket 24. The oil ejection opening 25 is located above the cam 4a thereby to lubricate contacting and sliding surfaces of the camshaft 4.

Thus, with this arrangement, lubrication with lubricating oil can be effectively achieved at the contacting surface between the swing arm 2 and the hydraulic lifter plunger 9 and at the contacting surface and sliding surfaces between the camshaft 4 and the swing arm 2.

Figure 3:
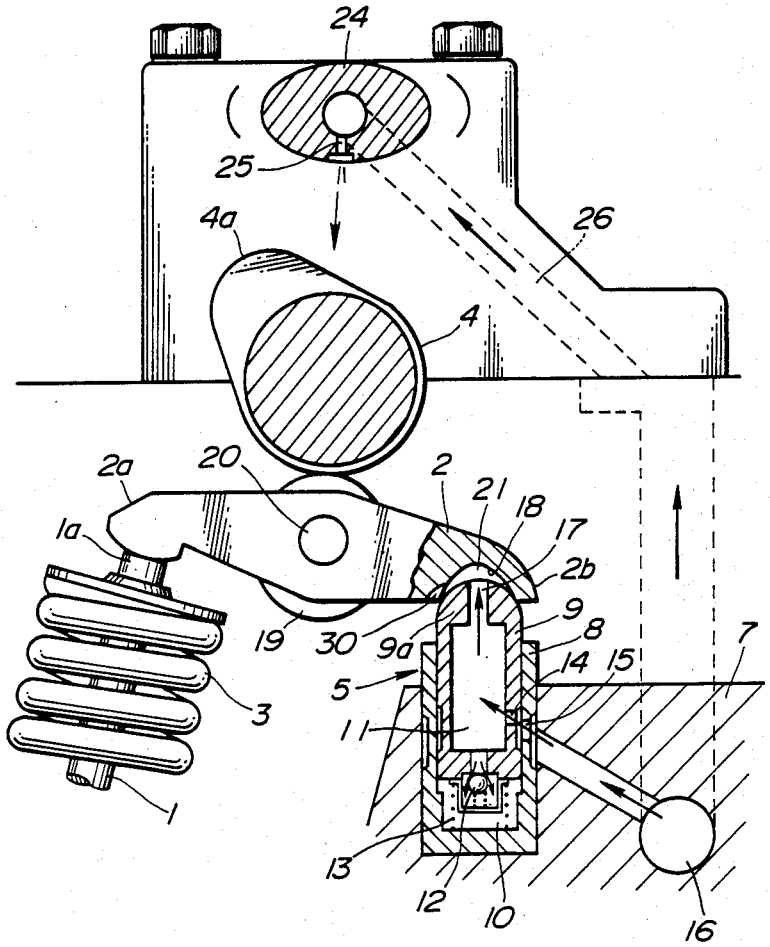
FIG. 3 is a fragmentary side view similar to FIG. 1 but showing a second embodiment of the valve operating system in accordance with the present invention.

FIG. 3 illustrates a second embodiment of the valve operating system according to the present invention, which is similar to the first embodiment of FIGS. 1 and 2 except for a communication passage through which the clearance 21 is communicated with the outside thereof. More specifically, a groove 30 serving as the communication passage is formed on the surface of the circular depression 18 of the swing arm 2 so that the clearance 21 is commuicated with the outside thereof. Accordingly, lubricating oil within the clearance 21 can be discharged therefrom only through the groove 30. The groove 30 is formed during casting of the swing arm 2.

With this arrangement, lubricating oil supplied to the clearance 21 between the swing arm 2 and the hydraulic lifter plunger 9 is discharged through the groove 30 formed on the surface of swing arm depression 18 to the outside of the swing arm 2 and the hydraulic lifter 5 to be returned into the cylinder head 7. As a result, if air is carried from the lubricating oil passage 16 to the clearance 21, the air is discharged through the groove 30 and therefore is prevented from staying within the clearance 21. This effectively allows lubricating oil to be sufficiently supplied to the clearance 21. thereby preventing oil shortage at the contacting surface between the swing arm 2 and the hydraulic lifter plunger 9. Thus, sufficient lubrication is achieved at the contacting surface between the swing arm 2 and the hydraulic lifter plunger 9 while effectivey cooling the contacting surface.

Figure 4:
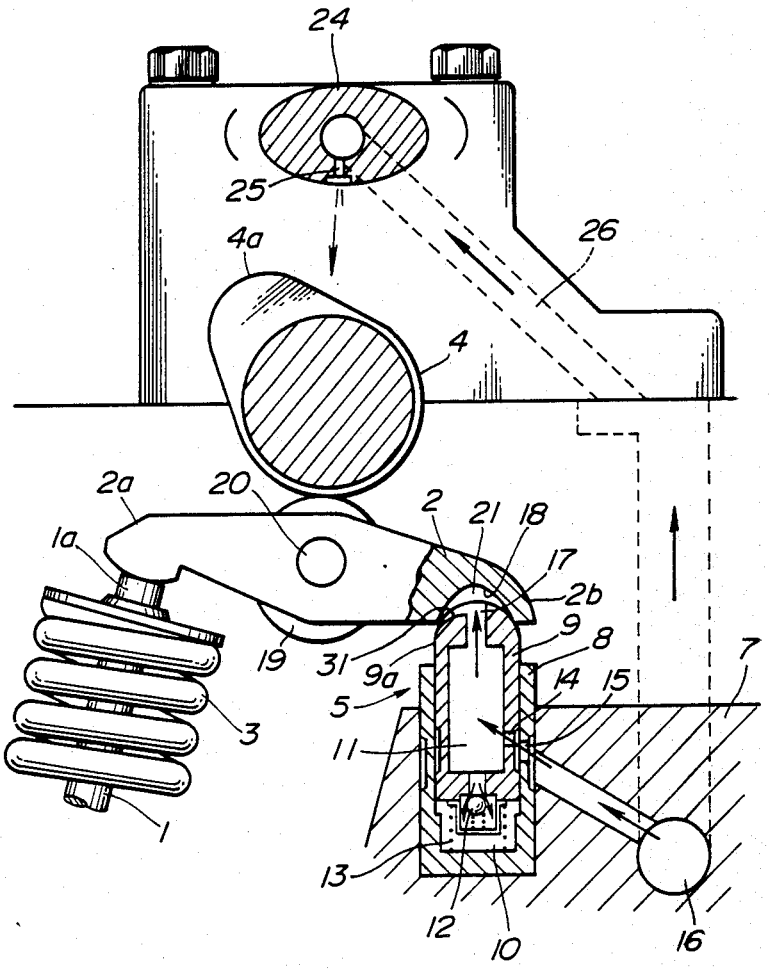
FIG. 4 is a fragmentary side view similar to FIG. 3 but showing a third embodiment of the valve operating system in accordance with the present invention.

FIG. 4 illustrates a third embodiment of the valve operating system according to the present invention, which is similar to the second embodiment of FIG. 3 with the exception that a groove 31 serving as the communication passage is formed on the outer surface of the generally hemispherical tip end section 9*a* of the plunger 9. The groove 31 is formed in such a manner tha the clearance 21 is communicated with the outside only through the groove 31, so that lubricating oil within the clearance 21 can be discharged through the groove 31 to the outside of the swing arm 2 and the hydraulic lifter 5. As a result, a sufficient lubrication can be accomplished at the contacting surface between the swing arm end section 2*b* and the hydraulic lifter plunger tip end section 9*a*.

While the end section 2*b* of the swing arm 2 has been shown and described as being pivotally supported by the tip end section 9*a* of the hydraulic lifter plunger 9 in such a manner that the supported position of the swing arm end section 2*b* is variable, it will be understood that the swing arm end section 2*b* may be supported by a support member which cannot vary the supported position of the swing arm end section 2*b*.

Although the swing arm 2 and the hydraulic lifter plunger 9 have been shown and described as being respectively formed with the circular depression 18 and the genererally hemispherical tip end section 9a in the above embodiments, it will be appreciated that the swing arm 2 and the plunger 9 may be inversely respectively formed with a generally hemispherical section and a circular depression.

While only one swing arm 2 and only one hydraulic lifter 5 have been shown in the above embodiments for the purpose of simplicity of illustration, it will be understood that a plurality of swing arms 2 and hydraulic valve lifters 5 are practically used for usual multi-cylinder internal combustion engines.

What is claimed is:

1. A valve operating system for an internal combustion engine, comprising:

a swing arm having a first end section connected to an engine valve, and a second end section, said swing arm being swingable around said second end section upon rotation of a camshaft;

a support member secured to the body of the engine and having an end section which fittingly contacts with said swing arm second end section;

means defining a clearance between said swing arm second end section and said support member end section, said clearance being filled with lubricating oil;

means defining an oil supply passage in said support member and communicating with said clearance, lubricating oil flowing through said oil supply passage and being supplied to said clearance;

means for establishing sealing contact between said swing arm second end section and said support member end section to maintain a fluid tight seal for said clearance; and means defining a communication passage for communicating said clearance with outside of said clearance so that lubricating oil within said clearance is discharged out of said clearance only through said communicating passage, said communicating passage being defined between said swing arm second end section and said support member end section, thereby interrupting said fluid tight seal, wherein said clearance (i) has a central axis that is perpendicular to an uppermost surface of said clearance and (ii) decreases in volume radially from said central axis to said fluid tight seal.

2. A valve operating system as claimed in claim 1, further comprising means for transmitting motion of said camshaft to a central section of said swing arm so that said swing arm swings around said second end section.

3. A valve operating system as claimed in claim 2, further comprising means for ejecting lubricating oil over said camshaft.

4. A valve operating system as claimed in claim 1, further comprising a cam follower roller rotatably attached to central section of said swing arm, said cam follower roller being in slidable contact with a cam of said camshaft.

5. A valve operating system as claimed in claim 1, wherein said support member is a hydraulic lifter including a lifter body securely supported by the body of the engine, a plunger slidably movably fitted within said lifter body and formed therein with said oil supply passage which is communicable with a lubrication oil passage formed in the body of the engine, means defining an oil pressure chamber between said lifter body and said plunger, said oil supply passage is communicable through a check valve with said oil pressure chamber.

6. A valve operating system as claimed in claim 6, wherein said swing arm is formed at its second end section with a circular depression, and said plunger has a generally hemispherical tip end section fitted in said swing arm circular depression.

7. A valve operating system as claimed in claim 7, wherein said communication passage defining means includes means defining a groove on a surface of said swing arm circular depression so that said clearance communicates through said groove with the outside of said clearance.

8. A valve operating system as claimed in claim 6, wherein said communication passage defining means includes means defining a groove on the generally hemispherical surface of said plunger.

9. A valve operating system as claimed in claim 1, wherein said swing arm first end section is bifurcated to have two end portions which are respectively connected to two engine valves.

10. A valve operating system as claimed in claim 1, wherein said engine valve is an intake valve for an engine cylinder.

11. A valve operating system as claimed in claim 1, wherein said engine valve is an exhaust valve for an engine cylinder.

12. A valve operating system for an internal combustion engine, comprising:

a swing arm having a first end section connected to an engine valve, and a second end section, said swing arm being swingable around said second end section upon rotation of a camshaft, said swing arm being formed at its second end section with a circular depression;

a support member secured to body of the engine and having an end section which fittingly contacts with said swing arm section end section, said support member end section having a generally hemispherical tip end section fitted in said swing arm circular depression so as to establish fluid tight seal therebetween;

means defining a clearance between said swing arm second end section and said support member end section, said clearance being filled with lubricating oil, said clearance being defined between surface of said circular depression of said swing arm and surface of said tip end section of said support member;

means defining an oil supply passage in said support member and communicating with said clearance, lubricating oil flowing through said oil supply passage and being supplied to said clearance;

means for establishing sealing contact between said swing arm second end section and said support member end section to maintain a fluid tight seal for said clearance; and means defining a communication passage for communicating said clearance with outside of said clearance so that lubricating oil within said clearance is discharged out of said clearance only through said communication passage, said communication passage being defined between the surface of said circular depression of said swing arm and the surface of said tip end section of said support member, thereby interrupting said fluid tight seal.

13. A valve operating system for an internal combustion engine, comprising:

a swing arm having a first end section connected to an engine valve, and a second end section, said swing arm being swingable around said second end section upon rotation of a camshaft;

a support member secured to body of the engine and having an end section which fittingly contacts with said swing arm second end section;

means defining a clearance between said swing arm second end section and said support member end section, said clearance being filled with lubricating oil;

means defining an oil supply passage in said support member and communicating with said clearance, lubricating oil flowing through said oil supply passage and being supplied to said clearance.

means for establishing sealing contact between said swing arm second end section and said support member end section to maintain a fluid tight seal for said clearance;

means defining a communication passage for communicating said clearance with outside of said clearance so that lubricating oil within said clearance is discharged out of said clearance only through said communication passage, said communication passage being defined between said swing arm second end section and said support member end section, thereby interrupting said fluid tight seal;

means for transmitting motion of said camshaft to central section of said swing arm so that said swing arm swings around said second end section; and means for ejecting lubricating oil over said camshaft.

* * * * *